US009790020B1

(12) United States Patent
Sebastian et al.

(10) Patent No.: US 9,790,020 B1
(45) Date of Patent: Oct. 17, 2017

(54) PACKAGING CONTAINER FOR A TOBACCO PRODUCT

(71) Applicant: R. J. REYNOLDS TOBACCO COMPANY, Winston-Salem, NC (US)

(72) Inventors: Andries D. Sebastian, Clemmons, NC (US); Percy D. Phillips, Pfafftown, NC (US)

(73) Assignee: R. J. REYNOLDS TOBACCO COMPANY, Winston Salem, NC (US)

( * ) Notice: Subject to any disclaimer, the term of this patent is extended or adjusted under 35 U.S.C. 154(b) by 0 days.

(21) Appl. No.: 15/097,019

(22) Filed: Apr. 12, 2016

(51) Int. Cl.

| | |
|---|---|
| ***A24F 15/00*** | (2006.01) |
| ***B65D 85/10*** | (2006.01) |
| ***H05B 37/02*** | (2006.01) |
| ***H05B 33/08*** | (2006.01) |

(52) U.S. Cl.
CPC ..... *B65D 85/1081* (2013.01); *A24F 15/00* (2013.01); *B65D 85/1045* (2013.01); *H05B 33/08* (2013.01); *H05B 37/0227* (2013.01); *H05B 37/0272* (2013.01)

(58) Field of Classification Search
CPC .... B65D 85/12; B65D 85/1045; B65D 25/14; B65D 85/70; B65D 31/00; B65D 65/42; B65D 75/26; B65D 75/30; B65D 75/5855; B65D 75/32; A24F 13/14; A24F 15/12; A24F 23/04; Y02E 60/12; B32B 15/08
See application file for complete search history.

(56) References Cited

U.S. PATENT DOCUMENTS

| | | | |
|---|---|---|---|
| 3,695,422 | A | 10/1972 | Tripocil |
| 3,874,581 | A | 4/1975 | Fox et al. |
| 3,944,066 | A | 3/1976 | Niepmann |
| 4,717,017 | A | 1/1988 | Sprinkel, Jr. et al. |
| 4,807,745 | A | 2/1989 | Langley et al. |
| 4,836,378 | A | 6/1989 | Lephamit |
| 4,852,734 | A | 8/1989 | Allen et al. |
| 5,161,733 | A | 11/1992 | Latif |

(Continued)

FOREIGN PATENT DOCUMENTS

| | | | |
|---|---|---|---|
| CN | 201914606 | U | 8/2011 |
| EP | 0392737 | A1 | 10/1990 |

(Continued)

OTHER PUBLICATIONS

International Search Report for International Application No. PCT/IB2017/052125 dated Jun. 8, 2017.

(Continued)

*Primary Examiner* — Minh D A
(74) *Attorney, Agent, or Firm* — Womble Carlyle Sandridge & Rice, LLP

(57) ABSTRACT

A packaging container for a tobacco product is provided. The packaging container comprises a housing including a flexible wall portion having an electrical device printed or placed on an exterior surface thereof, and a power source contained within the interior of the housing and configured to power the electrical device. The flexible wall portion comprises a layer including a nanocellulose coating configured to level the exterior surface for receipt of the electrical device, and a layer including a moisture vapor barrier configure to resist diffusion of moisture through the exterior surface and into an interior of the housing.

20 Claims, 6 Drawing Sheets

(56) References Cited

U.S. PATENT DOCUMENTS

| | | | | |
|---|---|---|---|---|
| 5,192,262 | A | 3/1993 | Amendola et al. | |
| 5,333,729 | A | 8/1994 | Wolfe | |
| 5,542,529 | A | 8/1996 | Hein, III et al. | |
| 5,595,803 | A | 1/1997 | May et al. | |
| 5,682,986 | A | 11/1997 | Cobler | |
| 5,699,903 | A | 12/1997 | Focke et al. | |
| 6,363,691 | B1 | 4/2002 | Flaherty | |
| 7,118,792 | B2 | 10/2006 | Hewitt et al. | |
| 7,484,619 | B2 | 2/2009 | Boriani et al. | |
| 8,016,105 | B2 | 9/2011 | Sendo | |
| 8,020,697 | B2 | 9/2011 | Chatelain | |
| 8,413,805 | B2 | 4/2013 | Bray | |
| 8,418,845 | B2 | 4/2013 | Tawada et al. | |
| 8,469,035 | B2 * | 6/2013 | Banerjee | A24B 15/165 131/194 |
| 9,204,362 | B2 | 12/2015 | Kruglick | |
| 9,345,268 | B2 * | 5/2016 | Stone | A24C 5/603 |
| 2008/0230410 | A1 | 9/2008 | Jones et al. | |
| 2010/0248926 | A1 | 9/2010 | Pipes et al. | |
| 2011/0042249 | A1 | 2/2011 | Guerrera et al. | |
| 2013/0292279 | A1 | 11/2013 | Bengtsson et al. | |
| 2017/0027220 | A1 * | 2/2017 | Sebastian | A24F 15/18 |

FOREIGN PATENT DOCUMENTS

| | | | |
|---|---|---|---|
| GB | 2510914 | A | 8/2014 |
| WO | 92/06842 | A1 | 4/1992 |
| WO | 00/55743 | A1 | 9/2000 |
| WO | 2010055312 | A1 | 5/2010 |
| WO | 2010138107 | A1 | 12/2010 |
| WO | 2012066308 | A2 | 5/2012 |
| WO | 2014072913 | A1 | 5/2014 |
| WO | 2016012798 | A1 | 1/2016 |
| WO | 2016024002 | A1 | 2/2016 |
| WO | 2017023695 | A1 | 2/2017 |

OTHER PUBLICATIONS

K. Torvinen et al., "Smooth and flexible filler-nanocellulose composite structure for printed electronics application", Cellulose, Kluwer Acedemic Publishers, vol. 19. No. 3, Feb. 29, 2012, pp. 821-829.

* cited by examiner

PACKAGING CONTAINER FOR A TOBACCO PRODUCT

TECHNOLOGICAL FIELD

The present disclosure relates to products made or derived from tobacco, or that otherwise incorporate tobacco, and are intended for human consumption. Of particular interest are packages for containing tobacco products such as cigarettes.

BACKGROUND

Popular "smoking" articles, such as cigarettes, have a substantially cylindrical, rod-shaped structure and include a charge, roll or column of smokable material such as shredded tobacco in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Typically, the filter element is attached to one end of the tobacco rod using a circumscribing wrapping material known as "tipping paper." A cigarette is employed by a smoker by lighting one end thereof and burning the tobacco rod. The smoker then receives mainstream smoke into his/her mouth by drawing on the opposite end (e.g., the filter end) of the cigarette. Other smoking articles include cigars or the burning of loose tobacco through a pipe.

Cigarettes conventionally have been sold in packages, each package normally containing twenty (20) cigarettes. Typical cigarette packages have a generally rectangular parallelepiped form. One type of popular cigarette package employs a container having the form of a so-called "hard pack," "crush proof box" or "hinged lid package." Such a package may include a lower base (e.g., receptacle) portion and a hinged upper lid portion. These types of packages are typically formed from cardboard blanks that include various panels and flaps, which when folded form the lower base portion and the upper lid portion. See, for example, U.S. Pat. No. 3,874,581 to Fox et al., U.S. Pat. No. 3,944,066 to Niepmann, U.S. Pat. No. 4,852,734 to Allen et al., and U.S. Pat. No. 5,682,986 to Cobler; as well as European Pat. 0392737 to Moeller; and U.S. Pat. Pub. Nos. 2008/0230410 to Jones et al., 2010/0248926 to Pipes et al., and 2011/0042249 to Guerrera et al., each of which is incorporated herein by reference. Another type of popular cigarette package employs a container having the form of the so-called "soft pack." See, for example, U.S. Pat. No. 3,695,422 to Tripodi, U.S. Pat. No. 4,717,017 to Sprinkel, Jr., et al., and, U.S. Pat. No. 5,333,729 to Wolfe; each of which is incorporated herein by reference. These conventional cigarette packages are generally configured to maintain the freshness and moisture content of the cigarettes, and to protect the cigarettes from adverse environmental conditions that could degrade their freshness and quality. These packages may include a laminate packaging component for barrier-sealed cigarettes including a foil layer, such as is described in U.S. Pat. No. 4,807,745 to Langley, and/or an outer film wrap of a type described by in U.S. Pat. No. 5,542,529 to Hein, each of which is incorporated herein by reference. Both types of cigarette packages are normally packed in cartons also of generally rectangular parallelepiped form, typically ten (10) packages to a carton.

In addition to maintaining the freshness and quality of the product, such packages may be utilized to communicate information to a consumer. For instance, graphics and text are typically applied to the exterior of the package to communicate various information regarding the product, including branding, advertising, regulatory information, nutritional information, and promotional information. Conventional cigarette packages are often relatively small in size and may have a limited visible exterior surface area for providing information. Thus, the information that may be provided via the available display surfaces may also be limited. Cigarette packages having additional display surfaces for communicating product information are known in the art. See, for example, U.S. Pat. No. 8,020,697 to Chatelain, U.S. Pat. No. 8,418,845 to Tawada et al., and U.S. Pat. No. 8,413,805 to Bray et al.; and PCT Pub. No. 2010/055312 to Griffiths et al., each of which is incorporated herein by reference.

It may be desirable to develop more attractive packaging for cigarettes, providing both visual and tactile attractiveness for consumers. In addition, it may be desirable to provide packaging that increases product quality and freshness.

BRIEF SUMMARY

The present disclosure relates to packaging containers for tobacco products. The present disclosure thus includes, without limitation, the following example implementations. In some example implementations, a packaging container is provided. The packaging container may comprise a housing including a flexible wall portion having an electrical device printed or placed on an exterior surface thereof, and a power source contained within the interior of the housing and configured to power the electrical device. The flexible wall portion may comprise a layer including a nanocellulose coating configured to level the exterior surface for receipt of the electrical device, and a layer including a moisture vapor barrier configure to resist diffusion of moisture through the exterior surface and into an interior of the housing.

In some example implementations of the packaging container of the preceding or any subsequent example implementation, or any combination thereof, the moisture vapor barrier has a moisture vapor transmission rate (MVTR) of less than 4 grams per meter squared per day.

In some example implementations of the packaging container of any preceding or any subsequent example implementation, or any combination thereof, the power source is electrically coupled to the electrical device through and without disruption of the moisture vapor barrier.

In some example implementations of the packaging container of any preceding or any subsequent example implementation, or any combination thereof, the electrical device includes an electroluminescent (EL), electrochromic (EC), light-emitting diode (LED) or electrochemical cell (LEC) light source.

In some example implementations of the packaging container of any preceding or any subsequent example implementation, or any combination thereof, the electrical device includes a light source, and the packaging container further comprises a control component contained within the interior of the housing, operatively coupled to the electrical device, and configured to cause the light source to illuminate in response to an external trigger.

In some example implementations of the packaging container of any preceding or any subsequent example implementation, or any combination thereof, the external trigger includes user interaction with the packaging container.

In some example implementations of the packaging container of any preceding or any subsequent example implementation, or any combination thereof, at least a portion of the housing is touch-sensitive, and the user interaction includes user contact with the touch-sensitive portion.

In some example implementations of the packaging container of any preceding or any subsequent example implementation, or any combination thereof, the external trigger includes wireless communication with the control component.

In some example implementations of the packaging container of any preceding or any subsequent example implementation, or any combination thereof, the wireless communication includes receipt by the control component of a near-field communication (NFC) trigger from an NFC transponder disposed proximate shelving configured to at least temporarily store the packaging container, and the control component is configured to receive the NFC trigger in response to the packaging container being stored on the shelving.

In some example implementations of the packaging container of any preceding or any subsequent example implementation, or any combination thereof, the housing comprises an outer casing including the flexible wall portion, an inner frame protruding from an upper end of the outer casing and defining an opening thereof, and a lid having an inner lid surface integrally jointed to a rear edge of the opening via a self-hinge mechanism. The inner frame may be configured for storing a plurality of tobacco products.

In some example implementations, a method is provided for controlling a packaging container. The method may comprise providing the packaging container comprising a housing including a flexible wall portion having an electrical device printed or placed on an exterior surface thereof, and a power source contained within an interior thereof. The flexible wall portion may comprise a layer including a nanocellulose coating configured to level the exterior surface for receipt of the electrical device, and a layer including a moisture vapor barrier configure to resist diffusion of moisture through the exterior surface and into the interior of the housing. The method may also comprise powering the electrical device using the power source.

In some example implementations of the method of the preceding or any subsequent example implementation, or any combination thereof, the moisture vapor barrier has a moisture vapor transmission rate (MVTR) of less than 4 grams per meter squared per day.

In some example implementations of the method of any preceding or any subsequent example implementation, or any combination thereof, powering the electrical device using the power source includes electrically coupling the power source to the electrical device through and without disruption of the moisture vapor barrier.

In some example implementations of the method of any preceding or any subsequent example implementation, or any combination thereof, the electrical device includes an electroluminescent (EL), electrochromic (EC), light-emitting diode (LED) or electrochemical cell (LEC) light source.

In some example implementations of the method of any preceding or any subsequent example implementation, or any combination thereof, the electrical device includes a light source, and the packaging container further comprises a control component contained within the interior of the housing and operatively coupled to the electrical device, and the method further comprises, at the control component, causing the light source to illuminate in response to an external trigger.

In some example implementations of the method of any preceding or any subsequent example implementation, or any combination thereof, the external trigger includes user interaction with the packaging container.

In some example implementations of the method of any preceding or any subsequent example implementation, or any combination thereof, at least a portion of the housing is touch-sensitive, and the user interaction includes user contact with the touch-sensitive portion, and causing the light source to illuminate in response to an external trigger includes causing the light source to illuminate in response to detecting the user contact with the touch-sensitive portion.

In some example implementations of the method of any preceding or any subsequent example implementation, or any combination thereof, the external trigger includes wireless communication with the control component.

In some example implementations of the method of any preceding or any subsequent example implementation, or any combination thereof, the wireless communication includes receipt by the control component of a near-field communication (NFC) trigger from an NFC transponder disposed proximate shelving configured to at least temporarily store the packaging container, and the causing the light source to illuminate in response to an external trigger includes causing the light source to illuminate in response to receiving the NFC trigger, the NFC trigger being received in response to the packaging container being stored on the shelving.

In some example implementations of the method of any preceding or any subsequent example implementation, or any combination thereof, the housing comprises an outer casing including the flexible wall portion, an inner frame protruding from an upper end of the outer casing and defining an opening thereof, and a lid having an inner lid surface integrally jointed to a rear edge of the opening via a self-hinge mechanism. The inner frame may be configured for storing a plurality of tobacco products.

These and other features, aspects, and advantages of the present disclosure will be apparent from a reading of the following detailed description together with the accompanying drawings, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as intended, namely to be combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying drawings which illustrate, by way of example, the principles of some described example implementations.

BRIEF DESCRIPTION OF THE DRAWING(S)

Having thus described the disclosure in the foregoing general terms, reference will now be made to the accompanying drawings, which are not necessarily drawn to scale, and wherein:

DETAILED DESCRIPTION

Figure 1:
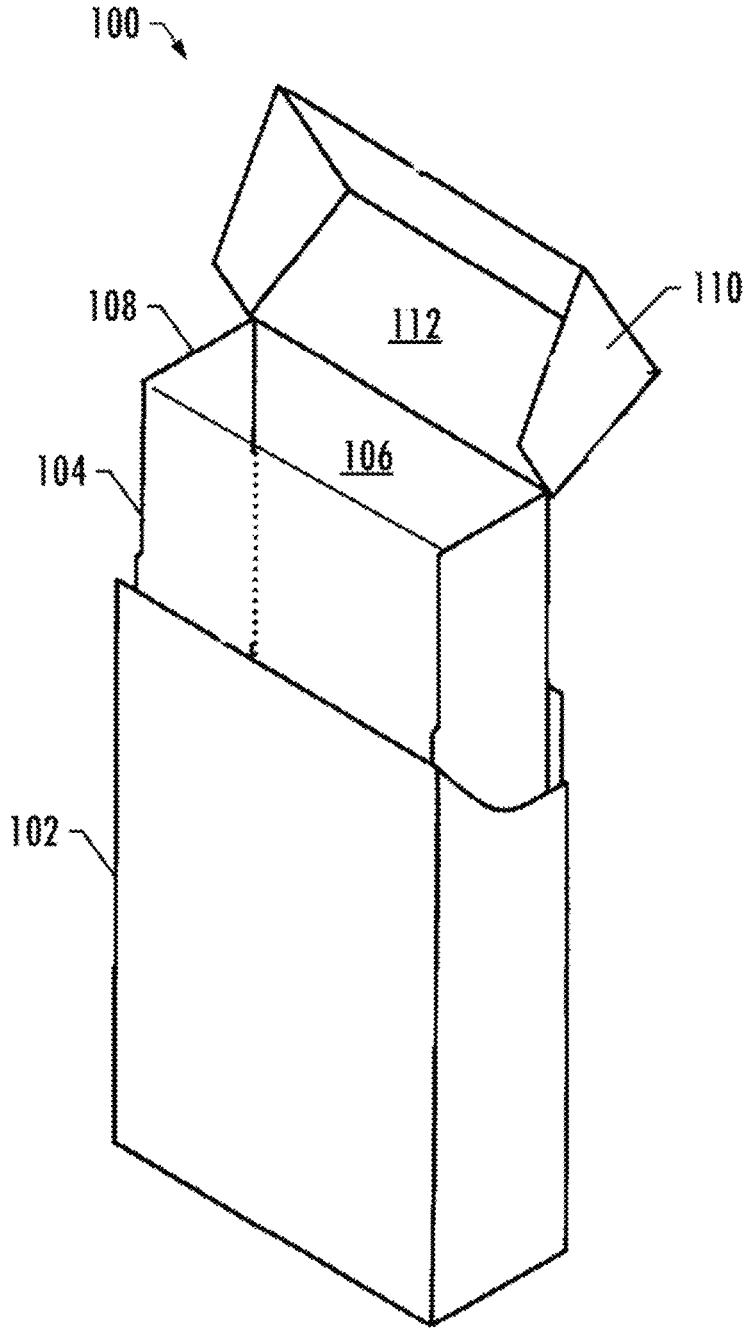
FIG. 1 illustrates a packaging container for tobacco products according to an example implementation of the present disclosure.

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise.

The present disclosure generally relates to packaging containers for tobacco products such as cigarettes. Cigarette packages may be generally configured to maintain the freshness and moisture content of the cigarettes and thereby protect the cigarettes from adverse environmental conditions that could degrade their freshness and quality. Cigarette packages may also be utilized as a means for branding, marketing and advertisement of the contents contained therein. Cigarette packages may typically comprise three separate components: (1) an inner foil liner comprising a metal foil laminated to a paper substrate or a metallized paper which is wrapped about the cigarettes and folded, but not sealed, at the ends of the cigarettes; (2) a "soft" or "hard" paper or paperboard package which is usually imprinted with brand specific information; and (3) an exterior clear overwrap of a heat sealable polymeric film which is heat sealed.

A strip of polymeric material known as a "tear tape" may be provided for easy opening of the polymeric overwrap films. Exemplary tear tapes are disclosed in U.S. Pat. No. 4,717,017 to Sprinkel, Jr. et al.; U.S. Pat. No. 4,836,378 to Lephardt; U.S. Pat. No. 5,192,262 to Amendola et al.; U.S. Pat. No. 5,595,803 to May et al.; U.S. Pat. No. 6,363,691 to Flaherty; and U.S. Pat. No. 7,118,792 to Hewitt et al., each of which is incorporated herein by reference. The tear tape may be typically positioned adjacent and parallel to the top edge of the package. One end of the tear tape normally projects slightly from the package as a tab. To open the package, the tab may be pulled by the smoker to open the polymeric overwrap. In particular, the projecting tab of the tear tape may be pulled to slit the polymeric overwrap along both edges of the tear tape and the polymeric overwrap covering the top of the container is removed. The top of the package may then be opened (e.g., the foil inner liner may be torn open in the case of the soft pack or the hinged lid of the hard pack may be pivoted open) and a portion of the foil inner liner may be removed to expose the ends of the cigarettes contained therein. The smoker may then grasps the end, usually the filter end, of a cigarette with his/her fingers to remove it from the package.

Typically, the polymeric overwrap material may comprise an oriented polypropylene which may be (a) a heat seal modified oriented polypropylene, (b) an acrylic heat seal coated polypropylene, or (c) a coextruded ABA type oriented polypropylene film wherein the A layers are fusion heat sealable polypropylene/polyethylene copolymer and the B layer is an oriented homopolymer of polypropylene. The composition of the heat seal layers is selected to optimize the heat sealing characteristics of the overwrap (e.g., the lowest practicable heat seal temperature and the shortest practicable dwell time). The heat seal layer of the overwrap may also provide the necessary slip or antistick characteristics so that overwrapped cigarette packages readily slip or slide relative to one another during the manufacturing process and during dispensing of the cigarette packages, for example, for a cigarette vending machine. Accordingly, selection of the heat seal layer composition may essentially be a tradeoff between optimum heat seal characteristics and optimum slip characteristics.

FIG. 1 illustrates a packaging container 100 for tobacco products according to example implementations of the present disclosure. It should be noted that the packaging container may be otherwise referred to herein as a "cigarette pack." As shown, the packaging container may include an outer casing 102 (a soft or hard casing) and an inner frame 104 having an inner frame surface 106. The inner frame may protrude from the upper end of the outer casing and define an opening 108 thereof. The inner frame may be configured for storing a plurality of products such as cigarettes, smokeless tobacco products, or the like. The packaging container may also include a lid 110 having an inner lid surface 112. The lid surface may be integrally jointed to a rear edge of the opening end of the inner frame with a self-hinge. As such, the lid may be rotatable around an axis of the self-hinge. In an alternative implementation (not shown), the lid may completely removable and replaceable.

The outer casing 102 may be or include a standard cuboid parallelepiped-shaped box, and may be configured as a hard-pack or a soft pack, assembled in a manner typically used for known cigarette packs. In other implementations, the geometry of the outer casing may be cylindrical or another three-dimensional geometry.

The outer casing 102 and inner frame 104 may be manufactured from various materials such as a fibrous material including fiberboard, cardboard, paper, thin foil, metal, another suitable material, or a combination thereof. In some example implementations, the outer casing may include a label or wrapper on an outer surface thereof. The wrapper may similarly be manufactured from various materials including paper, plastic, or another suitable material that may extend about a perimeter of the packaging container 100. The selection of packaging for the outer surface, label and/or wrapper may vary based at least in part on a number of factors such as aesthetics, branding or advertising, and/or desired barrier properties to provide additional protection from exposure to the atmosphere and the ingress or regress of moisture. The outer casing and inner frame may be prepared by known processes from a "blank" as described in U.S. Pat. No. 5,699,903 to Focke et al.; U.S. Pat. No.

5,161,733 to Latif; U.S. Pat. No. 7,484,619 to Boriani et al; and US Pub. No. 2005/0252796to Sendo, each of which is incorporated by reference herein. In some implementations, the outer casing may be manufactured separately and subsequently superimposed and adhered to the inner frame. Alternatively, the outer casing and inner frame may be manufactured simultaneously as one blank.

In some example implementations, the inner frame surface 106 and inner lid surface 112 may include at least one layer as described herein. According to one implementation, a layer composition as described herein may be randomly disbursed within the outer casing and inner frame during manufacture of the outer casing and inner frame which is present either in addition to the layer of the inner frame surface and inner lid surface or dispersed alone. In any of the aforementioned implementations, a layer composition as described herein can be applied to an inner surface of the outer casing.

Under normal storage conditions and normal shelf life, a conventional cigarette package may be capable of maintaining the freshness and moisture content of the cigarettes at an acceptable level for a limited period of time. However, if the cigarette packages are exposed to a longer than normal shelf life, or if the cigarette packages are stored in unusually hot and/or dry atmospheric conditions, the conventional package may not adequately preserve the freshness and moisture content of the cigarettes. In particular, a foil inner liner of the conventional cigarette package has a primarily decorative purpose inasmuch as the paper-backed foil liner is only overlapped at its longitudinal seam and folded over on the top and bottom of the package without sealing. Thus, the foil inner liner provides little or no barrier to the passage of oxygen and moisture between the cigarettes in the pack and the surrounding atmosphere. While the barrier effectiveness of the conventional heat sealed polypropylene overwrap is significantly greater than the conventional foil inner liner, the conventional overwrap does permit loss of moisture and flavor over a period of weeks so that the consumer can ascertain a change in the freshness of the product. If an extended shelf life or storage under adverse temperature and humidity conditions is encountered, there can result a staleness of the tobacco, a moisture loss, and a loss of tobacco flavor or aroma, including a loss of flavor additives, such as menthol.

Figure 2:
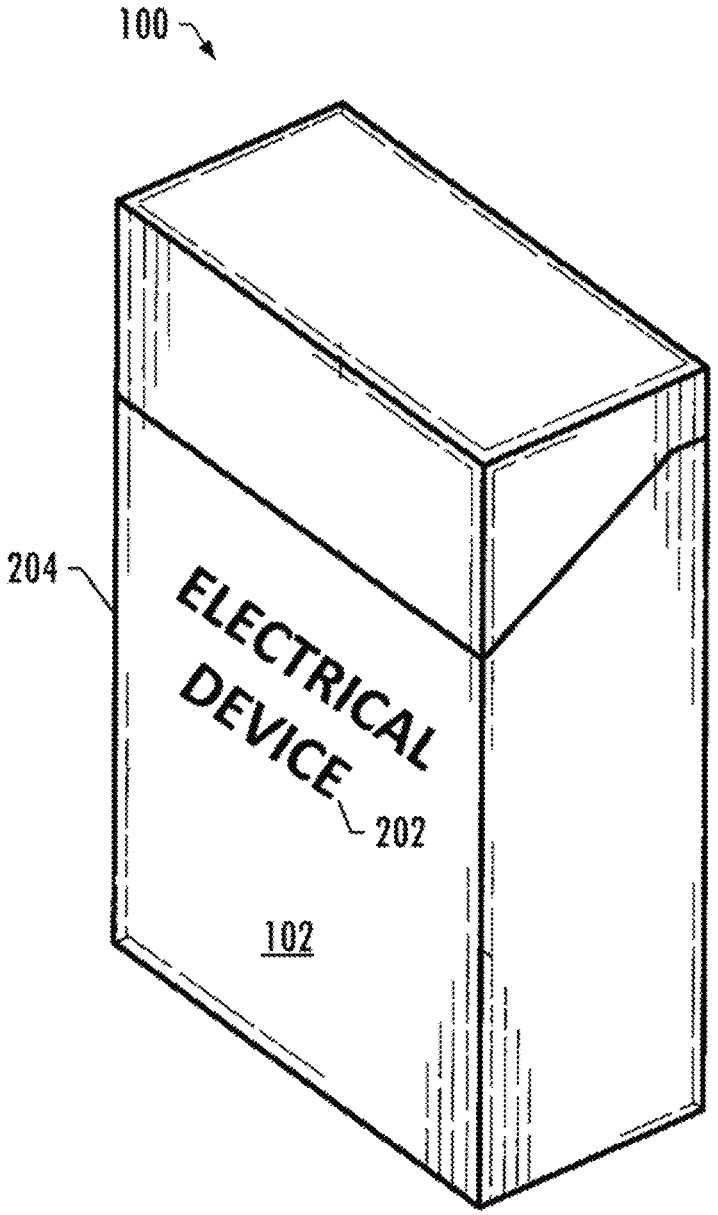
FIG. 2 illustrates the packaging container of FIG. 1 equipped with an electrical device, according to an example implementation of the present disclosure.

FIG. 2 illustrates the packaging container 100 equipped with an electrical device 202, according to an example implementation of the present disclosure. As shown in FIG. 2, in some example implementations, the packaging container may be or include a light-illuminating packaging container having a layered composition including at least a moisture vapor barrier. The outer casing 102 (which may be referred to as the housing hereinafter) of the packaging container may include a flexible wall portion 204 having the electrical device printed or placed on an exterior surface thereof. For example, the electrical device may be printed directly on the exterior surface or a laminated on the exterior surface. In some examples, the electrical device may be or include a light source.

Figure 3:
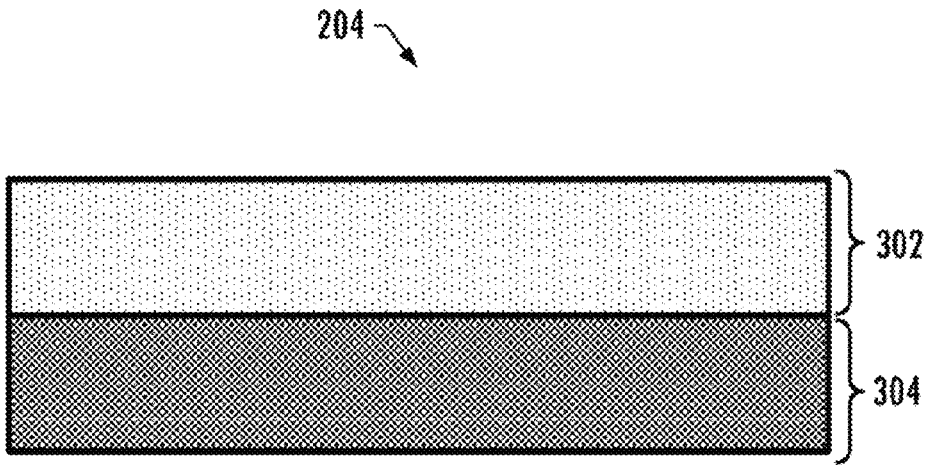
FIG. 3 illustrates various elements of a flexible wall portion, according to an example implementation of the present disclosure.

FIG. 3 illustrates various elements of the flexible wall portion 204 of FIG. 2, according to some example implementations. As shown, the flexible wall portion may comprise a layer 302 including a nanocellulose coating configured to level the exterior surface for receipt of the electrical device 202. In some examples, the nanocellulose coating may be or include a nanofibrillated and/or nanocrystalline cellulose. The flexible wall portion may also comprise a layer 304 including a moisture vapor barrier configure to resist diffusion of moisture through the exterior surface and into an interior of the housing. In these examples, the layers may respectively define top and/or bottom layers of the flexible wall portion. For example, moisture vapor barrier may be included in a bottom or inner of the flexible wall portion, or on a top or outermost/exterior layer of the flexible wall portion. In an implementation in which the electrical device includes a light source, the light output of the light source may gradually decay with time. For example, the output of an EL light source may gradually decay as the luminescent efficiency decreases. In these examples, presence of moisture may accelerate the decline. Thus, in some examples, the moisture vapor barrier has a moisture vapor transmission rate (MVTR) of less than 4 grams per meter squared per day or another suitable rate required for extending lifetime of the light source. For example, in some instances the moisture vapor barrier may have a MVTR of less than 4 grams per meter squared per day when measured at 38° C. and 90% relative humidity by the active standard test method for water vapor transmission rates (ASTM F1249).

In some examples, the light source of the electrical device 202 may include an electroluminescent (EL), electrochromic (EC), light-emitting diode (LED) or electrochemical cell (LEC) light source. In these examples, the light source may be configured to provide uniform surface illumination of complex shapes, low power consumption, and low heat generation, vibration and impact resistance. In some examples, the electrical device including an EL light source may comprise a capacitor structure having an inorganic phosphor (e.g., zinc sulfide compound) positioned between at least two electrodes.

Figure 5:
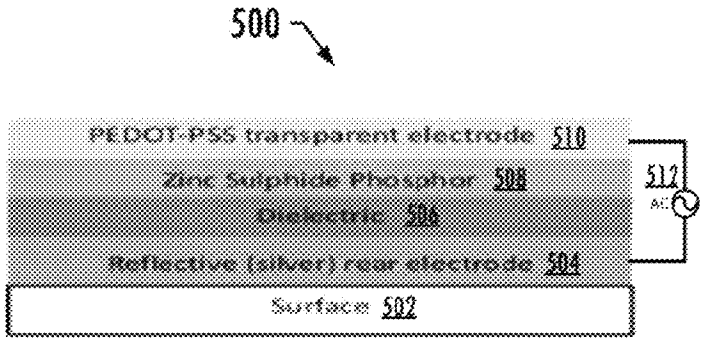
FIGS. 4 and 5 illustrate examples of a light source having a layered composition according to example implementations of the present disclosure.
Figure 4:
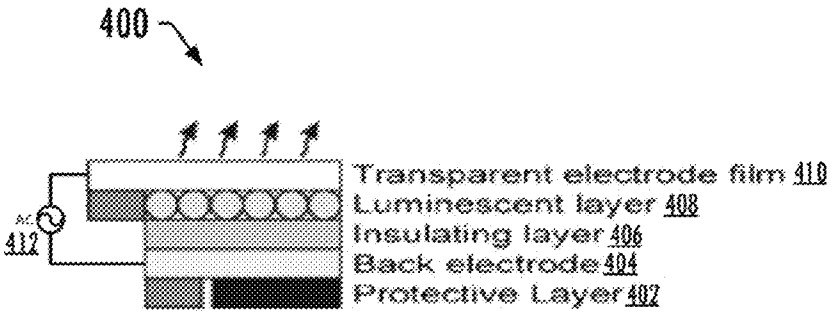

FIGS. 4 and 5 illustrate examples of suitable light sources that may be included as part of the electrical device 202 according to example implementations of the present disclosure. More particularly, FIG. 4 illustrates a bottom light-emitting EL device 400, and FIG. 5 illustrates a top light-emitting EL device 500. As shown in FIG. 4, the bottom light-emitting device may include a suitable transparent substrate or protective layer 402, a back electrode 404 that may be or include a silver or carbon conductor, an insulating layer 406, a luminescent phosphor layer 408, a transparent front electrode 410 that may be or include a polyester film having an indium tin oxide (ITO) therein, and a protective layer (not shown). As shown in FIG. 5, the top light-emitting device may include a suitable surface layer 502, a reflective rear electrode 504, a dielectric layer 506, a luminescent phosphor layer 508 (e.g., zinc sulfide phosphor), a transparent electrode 510, and a protective layer (not shown).

In some examples, as shown in FIG. 4, light may be emitted through the transparent substrate such as the transparent electrode film 410. In alternate examples, as shown in FIG. 5, light may be emitted through a deposited back electrode, one example of which may be the semi-transparent conductive polymer (PEDOT-PSS) 510. As further shown in FIGS. 4 and 5, an alternating current (AC) voltage 412, 512 may be applied across the electrodes to generate a changing electric field within the phosphor particles and thereby cause an emittance of light by the particles. The bottom light-emitting EL device 400 may be suitable for use with transparent substrates such as a plastic film, and the top light-emitting EL device 500 may be suitable for use with opaque substrates such as paper.

Figure 6:
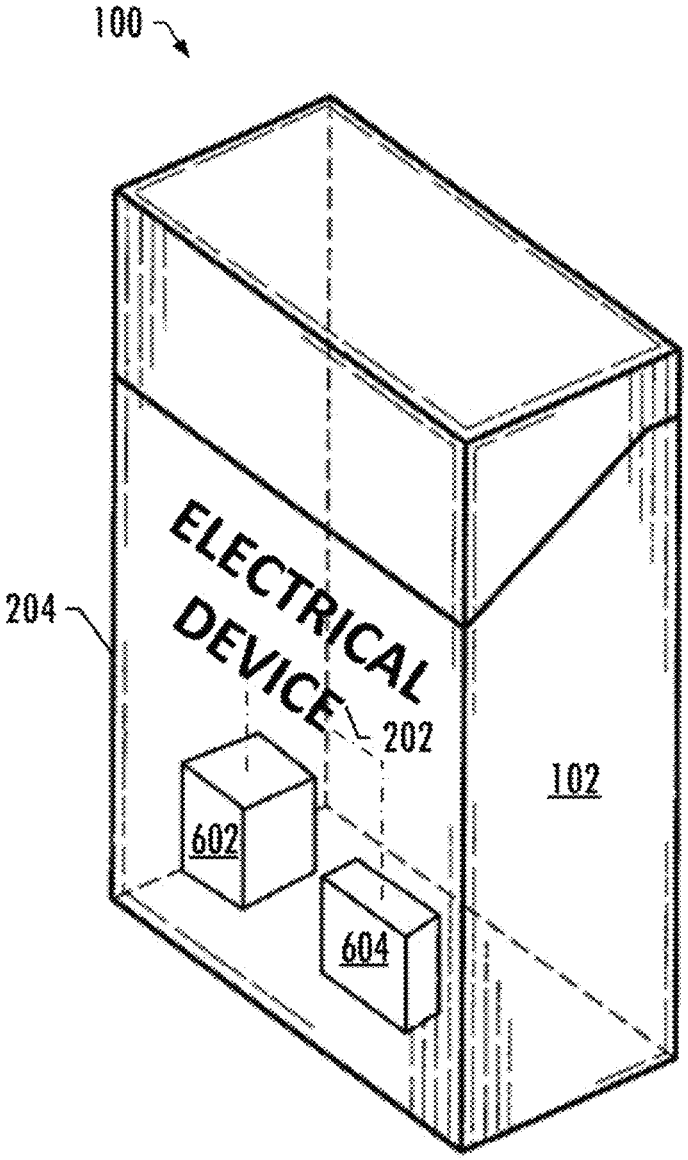
FIG. 6 illustrates example circuitry components of a light-illuminating packaging container according to an example implementation of the present disclosure.

FIG. 6 more particularly illustrates the packaging container 100 of FIGS. 1 and 2, including various electronic components according to example implementations of the present disclosure. As shown, the packaging container may further include a power source 602 contained within the interior of the housing 102 and configured to power the electrical device 202. In some examples, the power source may be or include an inverter in which the inverter may comprise a direct current to alternating current (DC-AC) converter configured to generate 60-120 AC having frequencies within a range of 50-1000 Hertz (Hz). As previously indicated, the flexible wall portion 204 of the packaging container may comprise a layer 304 including a moisture vapor barrier. In these examples, the power source may be electrically coupled to the electrical device 202 through and without disruption of the moisture vapor barrier.

In an implementation in which the electrical device 202 includes a light source, the packaging container 100 may include a control component 604 contained within the interior of the housing 102, coupled to the electrical device 202 and configured to control illumination of the light source (or otherwise cause the light source to illuminate). This may be accomplished in any of a number of different manners. In some examples, the light source may include appropriate terminals configured to selectively connect the light source to the power source 602. In some examples, these terminals may include a silver conductor and crimped connectors. Examples of a suitable control component include one or more of each of a number of electronic components such as a microprocessor (individually or as part of a microcontroller), application-specific integrated circuit (ASIC), field-programmable gate array (FPGA) or the like.

In some examples, the control component 602 may be configured to cause the light source of the electrical device 202 to illuminate in response to an external trigger. In some examples, the external trigger may be or include user interaction with the packaging container 100. More particularly, for example, at least a portion of the housing 102 may be touch-sensitive, and the user interaction may include user contact with the touch-sensitive portion. In another example, the external trigger may include wireless communication with the control component. In these examples, the wireless communication may include receipt by the control component of a near-field communication (NFC) trigger from an NFC transponder that may be proximately disposed to shelving that may be configured to at least temporarily stored the packaging container. Further in these examples, the control component may be configured to receive the NFC trigger in response to the packaging container being stored on the shelf. As such, wireless communication between the control component and the NFC transponder may be initiated in response to the packaging container being stored on the shelving.

Figure 7:
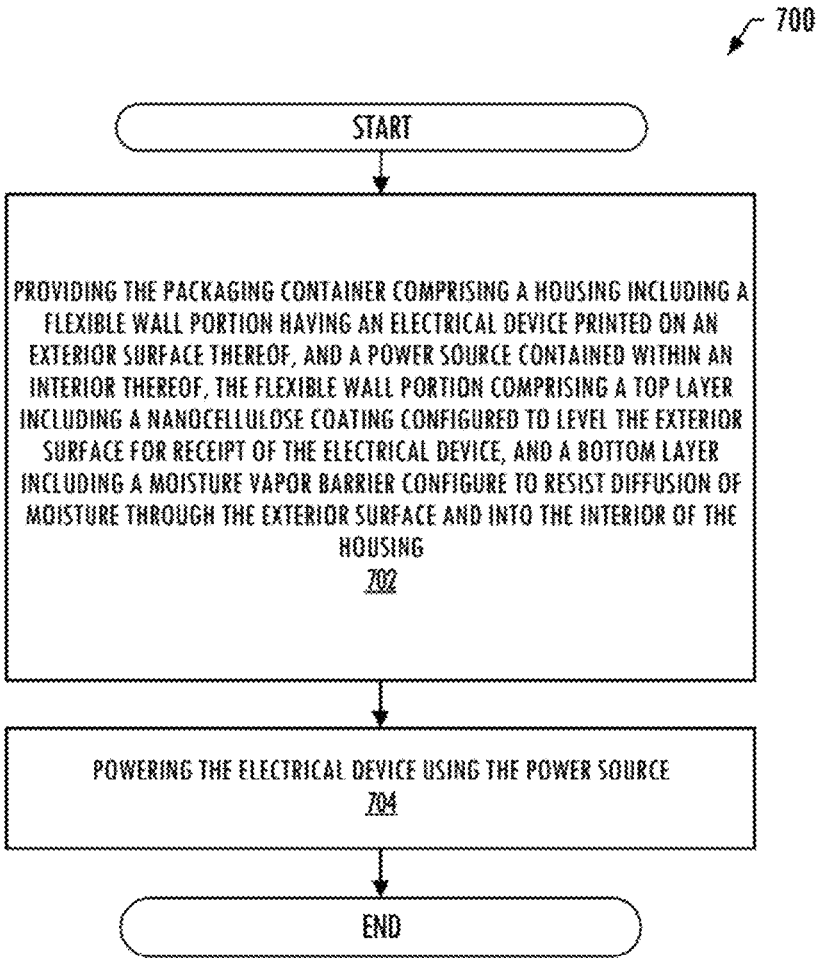
FIG. 7 illustrates various operations in a method for controlling a packaging container for tobacco products, according to an example implementation of the present disclosure.

FIG. 7 illustrates various operations in a method 700 of controlling a packaging container according to an example implementation of the present disclosure. As shown in block 702, the method may include providing a packaging container comprising a housing including a flexible wall portion having an electrical device printed on an exterior surface thereof, and a power source contained within an interior thereof. The flexible wall portion may comprise a layer including a nanocellulose coating configured to level the exterior surface for receipt of the electrical device, and a layer including a moisture vapor barrier configure to resist diffusion of moisture through the exterior surface and into the interior of the housing. The method may also comprise powering the electrical device using the power source, as shown at block 704.

The foregoing description of use of the article(s) may be applied to the various example implementations described herein through minor modifications, which may be apparent to the person of skill in the art in light of the further disclosure provided herein. The above description of use, however, is not intended to limit the use of the article but is provided to comply with all necessary requirements of disclosure of the present disclosure. Any of the elements shown in the article(s) illustrated in FIGS. 1-6 or as otherwise described above may be included in an aerosol delivery device according to the present disclosure.

Many modifications and other implementations of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific implementations disclosed, and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A packaging container comprising:

a housing including a flexible wall portion having an electrical device printed or placed on an exterior surface thereof, the flexible wall portion comprising:

a layer including a nanocellulose coating configured to level the exterior surface for receipt of the electrical device; and a layer including a moisture vapor barrier configure to resist diffusion of moisture through the exterior surface and into an interior of the housing; and a power source contained within the interior of the housing and configured to power the electrical device.

2. The packaging container of claim 1, wherein the moisture vapor barrier has a moisture vapor transmission rate (MVTR) of less than 4 grams per meter squared per day.

3. The packaging container of claim 1, wherein the power source is electrically coupled to the electrical device through and without disruption of the moisture vapor barrier.

4. The packaging container of claim 1, wherein the electrical device includes an electroluminescent (EL), electrochromic (EC), light-emitting diode (LED) or electrochemical cell (LEC) light source.

5. The packaging container of claim 1, wherein the electrical device includes a light source, and wherein the packaging container further comprises a control component contained within the interior of the housing, operatively coupled to the electrical device, and configured to cause the light source to illuminate in response to an external trigger.

6. The packaging container of claim 5, wherein the external trigger includes user interaction with the packaging container.

7. The packaging container of claim 6, wherein at least a portion of the housing is touch-sensitive, and the user interaction includes user contact with the touch-sensitive portion.

8. The packaging container of claim 5, wherein the external trigger includes wireless communication with the control component.

9. The packaging container of claim 8, wherein the wireless communication includes receipt by the control component of a near-field communication (NFC) trigger from an NFC transponder disposed proximate shelving configured to at least temporarily store the packaging container, and the control component is configured to receive the NFC trigger in response to the packaging container being stored on the shelving.

10. The packaging container of claim 1, wherein the housing comprises:

an outer casing including the flexible wall portion;

an inner frame protruding from an upper end of the outer casing and defining an opening thereof, the inner frame being configured for storing a plurality of tobacco products; and a lid having an inner lid surface integrally jointed to a rear edge of the opening via a self-hinge mechanism.

11. A method for controlling a packaging container, the method comprising:

providing the packaging container comprising a housing including a flexible wall portion having an electrical device printed or placed on an exterior surface thereof, and a power source contained within an interior thereof, the flexible wall portion comprising a layer including a nanocellulose coating configured to level the exterior surface for receipt of the electrical device, and a layer including a moisture vapor barrier configure to resist diffusion of moisture through the exterior surface and into the interior of the housing; and powering the electrical device using the power source.

12. The method of claim 11, wherein the moisture vapor barrier has a moisture vapor transmission rate (MVTR) of less than 4 grams per meter squared per day.

13. The method of claim 11, wherein powering the electrical device using the power source includes electrically coupling the power source to the electrical device through and without disruption of the moisture vapor barrier.

14. The method of claim 11, wherein the electrical device includes an electroluminescent (EL), electrochromic (EC), light-emitting diode (LED) or electrochemical cell (LEC) light source.

15. The method of claim 11, wherein the electrical device includes a light source, and the packaging container further comprises a control component contained within the interior of the housing and operatively coupled to the electrical device, and wherein the method further comprises, at the control component, causing the light source to illuminate in response to an external trigger.

16. The method of claim 15, wherein the external trigger includes user interaction with the packaging container.

17. The method of claim 16, wherein at least a portion of the housing is touch-sensitive, and the user interaction includes user contact with the touch-sensitive portion, and causing the light source to illuminate in response to an external trigger includes causing the light source to illuminate in response to detecting the user contact with the touch-sensitive portion.

18. The method of claim 15, wherein the external trigger includes wireless communication with the control component.

19. The method of claim 18, wherein the wireless communication includes receipt by the control component of a near-field communication (NFC) trigger from an NFC transponder disposed proximate shelving configured to at least temporarily store the packaging container, and the causing the light source to illuminate in response to an external trigger includes causing the light source to illuminate in response to receiving the NFC trigger, the NFC trigger being received in response to the packaging container being stored on the shelving.

20. The method of claim 11, wherein the housing comprises:

an outer casing including the flexible wall portion;

an inner frame protruding from an upper end of the outer casing and defining an opening thereof, the inner frame being configured for storing a plurality of tobacco products; and a lid having an inner lid surface integrally jointed to a rear edge of the opening via a self-hinge mechanism.

* * * * *